US005177140A

United States Patent [19]

Ogawa et al.

[11] Patent Number: 5,177,140

[45] Date of Patent: Jan. 5, 1993

[54] MATERIAL FOR MOLD AND PROCESS OF FORMING MOLD BY USING THIS MATERIAL

[75] Inventors: Fumiyuki Ogawa; Kyouji Tominaga, both of Niwa; Yoshiomi Ota, Nobeoka; Isao Kai; Kazuo Tamemoto, both of Tokyo; Mitsuhiro Osada, Niwa, all of Japan

[73] Assignee: Asahi Yukizai Kogyo Co. Ltd., Miyazaki, Japan

[21] Appl. No.: 474,037

[22] PCT Filed: Aug. 23, 1989

[86] PCT No.: PCT/JP89/00859

§ 371 Date: Apr. 12, 1990

§ 102(e) Date: Apr. 12, 1990

[87] PCT Pub. No.: WO90/02007

PCT Pub. Date: Mar. 8, 1990

[30] Foreign Application Priority Data

Aug. 23, 1988 [JP] Japan ..... 63-209673

[51] Int. Cl.[5] ..... C08L 39/02; C08K 3/22; C08K 3/38

[52] U.S. Cl. ..... 524/555; 524/430; 524/783; 524/786; 524/789

[58] Field of Search ..... 524/430, 783, 886, 789, 524/847

[56] References Cited

U.S. PATENT DOCUMENTS

| | | | |
|---|---|---|---|
| 2,801,984 | 8/1957 | Morgan et al. | 524/789 |
| 2,801,985 | 5/1957 | Roth | 524/789 |
| 3,021,298 | 2/1962 | Rakowitz | 524/789 |
| 3,892,704 | 7/1975 | Higashimura et al. | 524/650 |
| 4,174,331 | 11/1979 | Myles | 524/430 |

*Primary Examiner*—Paul R. Michl
*Assistant Examiner*—Peter Szekely
*Attorney, Agent, or Firm*—Burns, Doane, Swecker & Mathis

[57] ABSTRACT

A material for a mold which comprises, as main components, a refractory aggregate and a hardenable binder comprising a polyfunctional acrylamide having at least two ethylenically unsaturated groups in the molecule, has an excellent low-temperature rapid hardenability, disintegrability, and pot life and is especially suitable as a material for a mold for casting a low-melting-point metal such as an aluminum alloy.

15 Claims, 1 Drawing Sheet

MATERIAL FOR MOLD AND PROCESS OF FORMING MOLD BY USING THIS MATERIAL

TECHNICAL FIELD

The present invention relates to a material for a mold and a method of forming a mold by using this material. More particularly, the present invention relates to a material for a mold, which has a reaction mechanism broadly applicable to various reactions ranging from a normal-temperature hardening reaction to a heat hardening reaction, and a method of forming a mold by utilizing this reactivity.

BACKGROUND ART

The shell mold process, the hot box process or warm box process (hereinafter referred to as "the hot box process or the like") and the normal-temperature acid-hardening process are widely utilized today as a valuable mold-forming method. Since different materials suitable for these methods are used therefor, respectively, each method has inherent problems resulting from the material used.

In the shell mold process, since a phenolic resin is mainly used as the binder, when a low-melting-point metal such as an aluminum alloy or a magnesium alloy is cast, the core retains a high strength even after casting, because of a high heat resistance of the phenolic resin. Accordingly, to discharge the residual sand from the cast product, shocks are imposed by a chipping machine, or the operation of heat-treating the cast product in a heating furnace at 400 to 500° C. for several hours to thermally decompose the binder of the residual core sand for removal thereof is carried out. Therefore, a great deal of labor and a large amount of energy are necessary. Furthermore, since a phenolic resin is mainly used, the mold-forming temperature is high, in the range of from 250 to 350° C., and to reduce the energy cost, improve the working environment, prolong the life of the metal mold, and improve the freedom of the metal mold design for increasing the precision of the core, a reduction of the mold-forming temperature is desired. At present, however, a mass production of molds at temperatures lower than 200° C. is very difficult.

In the hot box process or the like, since an acidic compound is used as the hardener for a binder represented by a furan type compound and the sand is in the wet state, the metal mold is easily corroded and the pot life of the molding material is generally short, whereby the mold-forming operation is impeded.

In the normal-temperature acid-hardening process, an acid is used as the hardener as in the hot box process or the like, but since an organic sulfonic acid type is mainly used, a harmful gas such as sulfurous acid gas is generated when casting a metal, to cause a problem such as contamination of the working environment.

Therefore, an object of the present invention is to provide a novel material for a mold, which is hardened at normal temperature or a relatively low temperature, does not cause corrosion of a metal mold or contamination of the working environment, and manifests an excellent disintegrability of a formed mold and a good pot life, and a method of forming a mold by using this material.

DISCLOSURE OF THE INVENTION

With a view to attaining the above object, the inventors noted a polymerizable organic compound having a hardening mechanism different from that of the conventional binders, and investigated these compounds. As a result, it was found that a polyfunctional acrylamide described hereinafter has an excellent hardening function, and that the above-mentioned object can be attained by a mold-forming material comprising this acrylamide as a binder. The present invention is based on this finding.

More specifically, in accordance with the present invention, there is provided a material for a mold, which comprises a refractory aggregate and a hardenable binder as main components, wherein the hardenable binder comprises a polyfunctional acrylamide having at least two ethylenically unsaturated groups in the molecule.

Furthermore, in accordance with the present invention, there is provided a method of forming a mold by utilizing a broad reactivity of this mold-forming material.

The present invention will now be described in detail.

BEST MODE OF CARRYING OUT THE INVENTION

Figure 1:
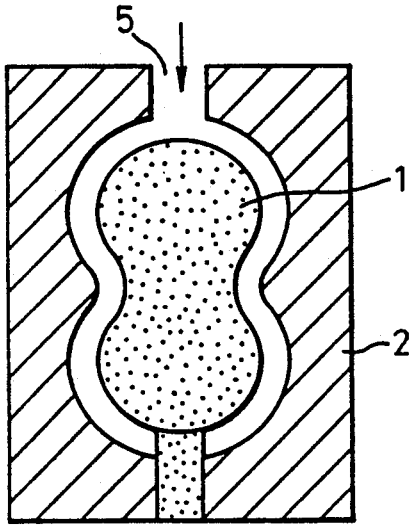
FIG. 1 and 2 are sectional views showing a test mold for evaluating the disintegrability described in the examples, and the state of the use of this test mold.
Figure 2:
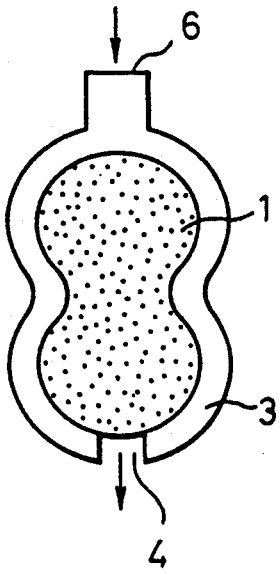

As typical examples of the refractory aggregate used in the invention, there can be used silica sand, special sands such as olivin sand, zircon sand, alumina sand and magnesia sand, slag type particles such as ferrochromium slag, ferronickel slag and converter slag, porous particles such as ceramic beads, and reclaimed particles thereof. Note, the refractory aggregate that can be used is not limited to those mentioned above, and refractory particles having a refractoriness sufficient to resist casting and having a particle size of about 0.05 to about 1.0 mm can be optionally used alone or in the form of a mixture.

The hardenable binder used in the present invention is a polyfunctional acrylamide which has, in the molecule, at least two ethylenically unsaturated groups derived from a monofunctional acrylamide according to a reaction type selected from the following reaction mechanisms.

(1) Reaction of an acrylamide type compound with an N-methylolacrylamide type compound and/or an N-alkoxymethylacrylamide type compound.

(2) Reaction of an N-methylolacrylamide compound per se or reaction of an N-methylolacrylamide type compound with an N-alkoxymethylacrylamide type compound.

(3) Reaction of an N-methyloloacrylamide type compound with a polyol.

(4) Reaction of an acrylamide compound with an aldehyde.

As the monofunctional acrylamide compound referred to herein, there can be mentioned an acrylamide type compound represented by the following formula (A):

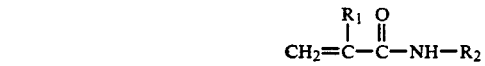

(A)

wherein $R_1$ and $R_2$, which may be the same or different, represent a hydrogen atom or a hydrocarbon group, an N-methylolacrylamide type compound obtained by reaction of this acrylamide type compound with formaldehyde, and an N-alkoxymethylacrylamide compound obtained by reaction of this N-methylolacrylamide compound with an alcohol.

Of these monofunctional acrylamides, those that can be advantageously used in view of the cost and easy availability include acrylamide, α-lower-alkyl-substituted acrylamides having 1 to 4 carbon atoms in the alkyl group, such as methacrylamide, α-propylacrylamide and α-butylacrylamide, N-methylolacrylamide, N-methylol-α-lower-alkyl-substituted acrylamides represented by N-methylolmethacrylamide, N-methoxymethylacrylamide, N-alkoxymethyl-α-lower-alkyl-substituted acrylamides represented by N-methoxymethylmethacrylamide, and mixtures thereof.

The above-mentioned reaction is generally carried out at a temperature of 30 to 100° C. for about 1 to about 24 hours in the presence of a catalyst. Preferably, water or an alcohol formed with advance of the reaction is removed by distillation to promote the reaction, and to prevent heat polymerization of the acrylamide, the reaction is carried out under a reduced pressure and/or under a blowing of air.

As the polyol, there can be used, for example, alkylene diols such as ethylene glycol, propylene glycol, butanediol, pentanediol and 1,6-hexanediol, polyoxyalkylene diols such as diethylene glycol, dipropylene glycol, polyethylene glycol and polypropylene glycol, aliphatic polyols such as glycerol, trimethylolpropane, pentaerthritol and sorbitol, aromatic polyols such as p-xylene glycol, reaction products having an alcoholic hydroxyl group, which are obtained by reaction of polyhydric phenols such as resorcinol and bisphenol with alkylene oxides such as ethylene oxide or alkylene carbonates such as ethylene carbonate, sucrose, and mixtures thereof.

As the aldehyde, there can be mentioned, for example, formaldehyde, acetaldehyde, butylaldehyde, propylaldehyde, glyoxal, acrolein, crotonaldehyde, benzaldehyde and furfural.

In general, an acid catalyst is preferably used as the catalyst, and organic acids such as oxalic acid and p-toluene-sulfonic acid are especially preferably used. The amount used of the catalyst is preferably 0.01 to 5 parts by weight per 100 parts by weight of the monofunctional acrylamide.

When carrying out the reaction, a known polymerization inhibitor can be added in addition to the above-mentioned blowing of air, or without the blowing of air. As the polymerization inhibitor, there can be used, for example, hydroquinone, t-butylhydroquinone, hydroquinone monomethyl ether, benzoquinone, diphenylbenzoquinone, 2,6-di-t-butylphenol, p-t-butylcatechol, N-phenyl-β-naphthylamine, N-nitrosodiphenylamine, phenothiazine and copper salts.

The polymerization inhibitor can be used not only for attaining the above-mentioned object but also as an agent for adjusting the pot life of the mold-forming material or as a storage stabilizer.

The polyfunctional acrylamide prepared in the above-mentioned manner has important properties for imparting the following characteristics to the mold-forming material.

(1) Since the water solubility is extremely low, a resistance against the absorption of moisture can be imparted to the mold-forming material.

More specifically, the moisture absorption of acrylamide belonging to the monofunctional acrylamide is 215 g/100 g and the moisture absorption of N-methylolacrylamide belonging to the monofunctional acrylamide is 196 g/100 g. In contrast, the moisture absorptions of ethylene glycol diacrylamide and 1,6-hexanediol diacrylamide, belonging to the polyfunctional acrylamide, are 7 g/100 g and less than 0.1 g/100 g, respectively.

(2) Since the polyfunctional acrylamide has at least two polymerizable double bonds having a high reactivity in the molecule and is capable of three-dimensional crosslinking and hardening, a hardening function of forming a strong mold at a low temperature can be rested to the mold-forming material.

(3) Since the polyfunctional acrylamide provides a crosslinked structure which is more easily heat-decomposed than the structure given by the conventional phenolic binder, an easy disinterability of a mold, which is desirable in the production of a cast product of aluminum, can be imparted to the mold-forming material.

(4) When a solid polyfunctional acrylamide is used, a dry mold-forming material suitable for the shell mold process is provided, and when a liquid polyfunctional acrylamide is used, a wet mold-forming material suitable for the hot box process or the like and the normal-temperature hardening process can be provided.

As examples of the polyfunctional acrylamide, there can be mentioned methylene-bis-acrylamide, ethylene-bis-acrylamide, methylene-bis-methacrylamide, diacrylamide dimethyl ether, ethylene glycol diacrylamide, 1,6-hexanediol diacrylamide, paraxylene glycol diacrylamide, glycerol diacrylamide, diacrylamides of bisphenols having an alcoholic hydroxyl group, glycerol triacrylamide, trimethylolpropane triacrylamide, pentaerythritol triacrylamide and corresponding α-lower-alkyl-substituted acrylamides, although the polyfunctional acrylamide that can be used is not limited to those exemplified above.

These polyfunctional acrylamides can be used alone or in the form of mixtures of two or more thereof.

As pointed out hereinbefore, a binder composed mainly of a solid polyfunctional acrylamide is used as the binder of a dry mold-forming material suitable for the shell mold process. In view of the preparation ease, cost, moisture absorption resistance, and mold characteristics, a binder composed mainly of at least one member selected from bifunctional acrylamides represented by the following formulae (I), (II) and (III) is preferably used:

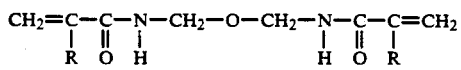

(I)

-continued

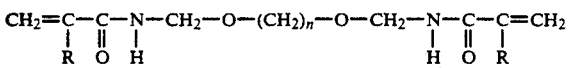

(II)

and

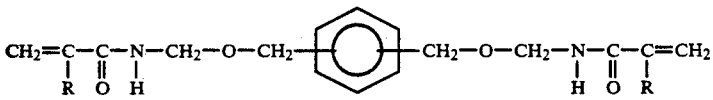

(III)

wherein R represents a hydrogen atom or an alkyl group having 1 to 5 carbon atoms, and n is an integer of from 2 to 6.

Figure 3:
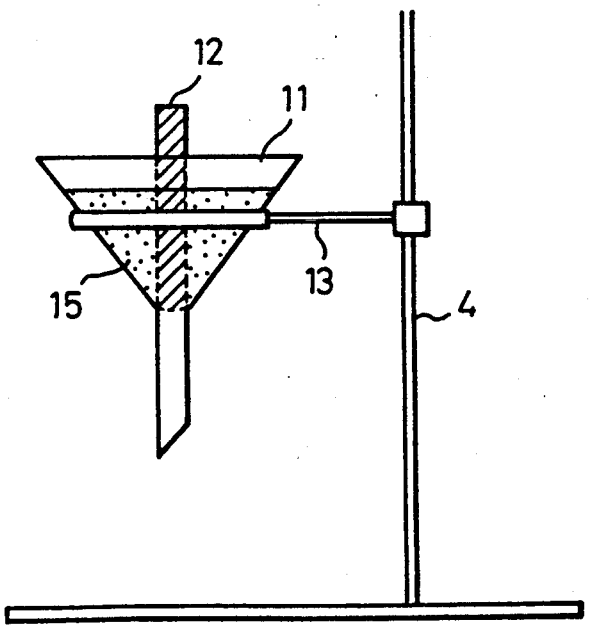
FIG. 3 is a diagram illustrating the apparatus for evaluating the flowability of a mold-forming material.

By the term "the dry state" used in the present specification is meant that state in which an agglomeration of the binder-coated refractory aggregate at normal temperature does not occur and the binder-coated refractory aggregate has the appearance of a dry refractory aggregate, and particularly, a free flowability that can be measured by the method of evaluating the flowability of a mold-forming material, as shown in FIG. 3, can be manifested.

Furthermore, in the present invention, a mixture composed mainly of a polyfunctional acrylamide in which a monofunctional acrylamide is incorporated intentionally or as an unreacted substance in the polyfunctional acrylamide prepared by one of the above-mentioned reaction mechanisms can be used as the hardenable binder. In this case, in view of the moisture absorption resistance of the mold-forming material and the mold, preferably the monofunctional acrylamide/polyfunctional acrylamide weight ratio is from 0/100 to 30/70, most preferably from 0/100 to 20/80.

The hardenable binder of the present invention is used in an amount of 0.3 to 5 parts by weight, preferably 0.5 to 3 parts by weight, per 100 parts by weight of the refractory aggregate.

This hardenable binder can be crosslinked and cured only by heating. Where a prompt heat hardening is desired, or hardening is effected at normal temperature, a known curing promoter is used.

Polymerization initiators such as a radical polymerization initiator and an ion polymerization initiator, or mixtures of such polymerization initiators with polymerization promoters (redox catalysts) can be used as the curing promoter.

As the radical polymerization initiator, there can be mentioned azo compounds such as azobisisobutyronitrile and azobisisovaleronitrile, organic peroxides such as benzoyl peroxide, methylethylketone peroxide, acetyl peroxide, t-butyl hydroperoxide, di-t-butyl peroxide, cumene hydroperoxide, dicumyl peroxide, t-butyl perbenzoate, p-chlorobenzoyl peroxide and cyclohexanone peroxide, and inorganic peroxides such as potassium persulfate, ammonium persulfate, and hydrogen peroxide. As the ion polymerization initiator, there can be mentioned, for example, sodium methoxide, potassium methoxide, and triethylamine.

Of these polymerization initiators, organic peroxides are most preferable.

As the redox catalyst, there can be mentioned sulfites such as sodium hydrogensulfite, sulfoxylates such as sodium aldehyde-sulfoxylate, metal soaps such as cobalt octenate and cobalt naphthenate, tertiary amines such as dimethylaniline and triethylamine, and mercaptans.

The curing promoter is used in an amount of 0.001 to 10 parts by weight per 100 parts by weight of the hardenable binder.

If the hardenable binder of the present invention is used in combination with a known silane coupling agent or titanate coupling agent, the mold characteristics such as the moisture absorption resistance and strength can be improved. As the coupling agent, there can be mentioned, for example, vinyl silanes such as vinyltrimethoxysilane, vinyltris(β-methoxy)silane and vinyltris(β-methoxyethoxy)silane, methacryloxysilanes such as γ-methacryloxypropyltrimethoxysilane and γ-methacryloxypropyltris(β-methoxyethoxy)silane, epoxy silanes such as β-glycidoxypropyltrimethoxysilane and β-(3,4-epoxycyclohexyl)ethyltrimethoxysilane, aminosilanes such as N-β-(aminoethyl)-γ-aminopropyltrimethoxysilane and γ-aminopropyltriethoxysilane, mercaptosilanes such as γ-mercaptopropyltrimethoxysilane, isopropyl-tris(di-octylpyrophosphate)titanate, and mixtures thereof.

In general, the coupling agent is used in an amount of 0.01 to 5 parts by weight per 100 parts of the hardenable binder.

If the dry mold-forming material of the present invention is used in combination with a solid or liquid saturated amide compound or solid alcohol (hereinafter referred to as "additive A"), the strength of the formed mold can be improved. If the dry mold-forming material of the present invention is used in combination with a thermoplastic resin (hereinafter referred to as "additive B"), the free flowability, blocking resistance, and moisture absorption resistance can be improved.

The additive A exerts a function of reducing the melt viscosity of the hardenable binder upon heating, and improving the strength of the mold.

Preferably, the solid substance as the additive A has a melting point lower than 140° C., more preferably lower than 120° C., in view of the improvement of the strength of a mold formed at a low temperature, for example, at a temperature lower than 250° C.; although the preferable melting point differs to some extent according to the mold-forming temperature and the kind of hardenable binder. Nevertheless, to improve the strength of a mold formed at a high temperature such as adopted in the conventional technique, even a solid having a melting point higher than 140° C. can be effectively used.

As the saturated amide compound, there can be mentioned, for example, acetic acid amide, acetanilide, acetoacetic acid anilide, acetoacetic acid xylidide, acetoacetic acid toluidide, N-methylbenzamide, benzamide, propionamide, methylolstearic acid amide, stearic acid amide, ε-caprolactam, dimethylacetamide, dimethylformamide, and formamide. As the solid alcohol, there can be mentioned, for example, 1,6-hexanediol, trimethylolpropane, p-xylene glycol, and carbitol. These substances can be used alone or in the form of a mixture of two or more thereof. The additive is used in an amount of 0.01 to 20 parts by weight, preferably 0.1 to 10 parts by weight, per 100 parts by weight of the hardenable binder. If the amount of the additive is smaller than 0.01 part by weight, the effect of improving the strength of the mold cannot be attained. If the amount of the additive is larger than 20 parts by weight, the curing speed is lowered and good results cannot be obtained. The additive A can be added to the hardenable binder in advance or added at the time of the preparation of the mold-forming material.

The thermoplastic resin used as the additive B exerts not only a function of covering the hardenable binder layer formed on the surface of the refractory aggregate, to shield the binder from the outer atmosphere and prevent peeling of the binder from the surface of the aggregate, but also a function of imparting a lubricating property to the mold-forming material by the self-lubricating property of the thermoplastic resin, to improve the free flowability, blocking resistance and moisture absorp-resistance of the mold-forming material and prevent a lowering of the strength of the formed mold.

As preferable examples of the thermoplastic resin, there can be mentioned a vinyl acetate resin, an ethylene/vinyl acetate copolymer resin, an ethylene/-methacrylic acid ester copolymer resin, a methacrylic acid ester resin, a polystyrene resin, an acrylonitrile/styrene copolymer resin, a polybutyral resin, and a polyethylene resin. Of these thermoplastic resins, a vinyl acetate or a same copolymer resin, particularly a vinyl acetate resin, is most preferable because an effect of improving the strength of the mold is attained in addition to the effect of improving the above-mentioned characteristics. These thermoplastic resins can be used alone or in the form of mixtures of two or more thereof. The thermoplastic resin is used in an amount of 1 to 20 parts by weight, preferably 2 to 10 parts by weight, per 100 parts by weight of the hardenable binder. If the amount of the thermoplastic resin is smaller than 1 part by weight, the effects of improving the free flowability, blocking resistance and moisture absorption resistance of the mold-forming material, and preventing a lowering of the strength of the mold, cannot be attained. If the amount of the thermoplastic resin is larger than 20 parts by weight, the curing speed is reduced and good results cannot be obtained. In general, the additive B is added in the form of a solution or dispersion in a volatile solvent such as acetone, methanol, ethanol, tetrahydrofuran, toluene, benzene or ethyl acetate, or in the form of a fine powder after the addition of the hardenable binder at the time of the preparation of the mold-forming material.

If desired, the hardenable binder of the present invention may further comprise, in addition to the above components, for example, ethylenically unsaturated compounds other than said acrylamides, such as unsaturated polyester compounds, acrylic compounds and diallyl phthalate compounds, and epoxy compounds, melamine compounds, urea compounds, furan compounds, reaction products thereamong, and reaction products of these compounds with acrylamides. Furthermore, the hardenable binder of the present invention may contain an unreacted component, such as a polyol, incorporated at the time of the preparation of the polyfunctional acrylamide. A higher content of the polyfunctional acrylamide in the hardenable binder is preferable. Namely, preferably the polyfunctional acrylamide content is at least 50% by weight, more preferably at least 70% by weight, most preferably at least 90% by weight. The upper limit is determined in view of the difficulty of the preparation and of the cost. Moreover, a solid hardenable binder-dissolving solvent such as water or an organic solvent, a wax such as an aliphatic amide or calcium stearate, iron sand, red iron oxide, a deodorizing agent such as stop odor, and other auxiliary components can be incorporated into the mold-forming material.

The mold-forming material of the present invention can be prepared by appropriately adopting various coating methods customarily used in the art, for example, the hot marling method and cold marling method. The curing promoter, coupling agent, and additive A as mentioned above are generally incorporated in advance or added at the start of mixing or before the charging of the binder. The additive B is added after the charging of the binder.

For the production of the dry mold-forming material in the present invention, the cold marling method is preferably adopted, for the reason described below.

In general, the hot marling method has been adopted for the production of a mold-forming material comprising a phenolic binder, but the cold marling method is rarely adopted because the productivity is low, the flowability of the mold-forming material is low, and the binder is readily separated. In contrast, in the case of the solid hardenable binder of the present invention, even if the cold marling method is adopted, a mold-forming material in a good coated state comparable to that attained by the hot marling method is provided, and the above-mentioned disadvantages do not arise. Adoption of the cold marling method brings advantages such as a simplification of the preparation apparatus and a reduction of the energy cost.

The mold-forming material of the present invention can be formed into a mold in the same manner as in the known shell mold process, the hot box process or the like, or the normal-temperature hardening process. For example, according to the shell mold process or the hot box process or the like, the mold-forming material is filled in a heated metal mold by the blowing or dumping method and cured, and the mold is released from a heated metal mold. According to the normal-temperature hardening process, the mold-forming material is filled in a pattern by the tamping method and allowed to stand at normal temperature for a predetermined time, and the mold is then released from a pattern.

The mold formed from the mold-forming material of the present invention can be used as a main mold or core for casting steel, iron and a low-melting-point metal, especially for casting a low-melting-point metal.

The following effects are obtained according to the present invention.

(1) Since the mold-forming material of the present invention has a property such that the material is cross-linked and hardened by the polymerization reaction, a wet or dry mold-forming material having a normal-temperature hardenability or heat hardenability according to the intended object can be provided by appropriately selecting the hardenable binder, curing promoter, and polymerization inhibitor.

(2) The dry mold-forming material has (i) an excellent low-temperature hardenability valuable for the shell mold process.

Namely, since this mold-forming material can be formed into a mold at a temperature of about 130 to about 180° C., the standard mold-forming temperature (250 to 300° C.) in the shell mold process can be greatly lowered to a level lower than the standard mold-forming temperature (180 to 250° C) adopted in the hot box process or the like. Accordingly, an energy saving effect is attained, and moreover, an effect of moderating distortion of the metal mold and an effect of improving the working embodiment can be obtained.

Furthermore, (ii) the disintegrability of a mold to be used for low-temperature casting, for example, for a casting of aluminum, is excellent. Accordingly, the costs of energy and labor required for the knockout and/or heat treatment for the removal of the mold from the cast product can be reduced, the manufacturing efficiency can be increased, and noise in the working environment can be reduced.

Similar effects can be obtained in other mold-forming processes using the wet mold-forming material. Moreover, (iii) the strength of the mold can be improved if a saturated amide compound or solid alcohol is further incorporated in the mold-forming material. Still further, if a thermoplastic resin is further incorporated, the free flowability, blocking resistance, and moisture absorption resistance can be improved.

(3) The wet mold-forming material has (i) an excellent low-temperature hardenability valuable for the hot box process or the like, and has an excellent pot life in the hot box process or the like and the normaltemperature hardening process. For example, the pot life is about 3 to about 6 times the pot life of the conventional mold-forming material. Accordingly, the mold-forming operation is not impaired as in the conventional method, a cleaning of the sand left in the molding machine can be easily accomplished, and the loss of the mold-forming material can be reduced. Moreover, since an acidic hardening agent is not used, (iii) problems arising in the conventional method, such as a corrosion of the metal mold at the mold-forming step or casting step and a contamination of the working environment with a harmful gas such as sulfurous acid gas, do not occur, at the casting step.

The reasons why the mold-forming material of the present invention provide such excellent performances have not been completely elucidated, but it is considered that these reasons are probably as follows.

(1) Since the hardenable binder of the present invention is composed mainly of an acrylamide compound having at least two polymerizable double bonds having a high reactivity in the molecule, the mold-forming material comprising this binder is more easily three-dimensionally crosslinked and cured at a low temperature to provide a mold than the conventional mold-forming material comprising a binder of the addition condensation type.

(2) Since the hardenable binder of the present invention forms a crosslinked structure, which is more easily heat-decomposed than the structure formed by the conventional phenolic binder, the obtained mold can be easily disintegrated with a smaller quantity of heat energy than in the conventional mold.

(3) The curing promoter used in the present invention is different from the conventional acidic curing agent which immediately promotes curing of the binder at the time of mixing, but after a passage of a certain time required for a formation of radicals necessary for causing the polymerization reaction, that is, the "certain induction time", the curing promoter of the present invention promptly cures the binder. Accordingly, by appropriately selecting the curing promoter or using the curing promoter in combination with a polymerization inhibitor, a good pot life at normal temperature can be given to the mold-forming material.

Similarly, by selecting curing promoters differing in radical-forming temperature, the mold-forming temperature can be optionally adjusted according to the object of use.

(4) Since an acidic curing agent is not used for the mold-forming material of the present invention, problems appearing in the conventional technique, such as a contamination of the working environment and corrosion of the metal mold, do not arise.

The present invention will now be described in detail with reference to the following examples, that by no means limit the scope of the invention.

PRODUCTION EXAMPLE 1

A reaction vessel equipped with a pressure-reducing mechanism and an air-blowing mechanism was charged with 404 g of N-methylolacrylamide (hereinafter referred to as "N-MAM"), 124 g of ethylene glycol, 1% by weight, based on N-MAM, of oxalic acid and $5\times10^{-3}$% by weight, based on N-MAM, of hydroquinone, the mixture was stirred, and the temperature was elevated to 70° C. under a reduced pressure while blowing air into the reaction vessel. At this temperature, the reaction was carried out for 6 hours while removing water by distillation. Acetone was added to the reaction mixture to dissolve the reaction mixture herein, the solution was filtered, and a hardenable binder A having a melting point of 80° C., which was composed mainly of ethylene glycol diacrylamide, was obtained by crystallization from the filtrate.

PRODUCTION EXAMPLE 2

A hardenable binder having a melting point of 85° C., which was composed mainly of 1,6-hexanediol diacrylamide, was prepared in the same manner as described in Production Example 1 except that 236 g of 1,6-hexanediol was used instead of ethylene glycol used in Production Example 1.

PRODUCTION EXAMPLE 3

The same reaction vessel as used in Production Example 1 was charged with 404 g of N-MAM, 276 g of p-xylene glycol, 200 g of acetone, 1% by weight, based on N-MAM, of oxalic acid and $5\times10^{-3}$% by weight, based on N-MAM, of hydroquinone, the temperature was elevated 30 to 70° C. with stirring, and the reaction was carried out at this temperature for 1 hour. Further, the reaction was carried out at this temperature for 2 hours while removing water and acetone by distillation under a reduced pressure, acetone was added to the reaction mixture to dissolve the reaction mixture therein, the solution was filtered, and a hardenable binder C having a melting point of 90° C., which was composed mainly of p-xylene glycol diacrylamide, was obtained by crystallization from the filtrate.

PRODUCTION EXAMPLE 4

A reaction vessel equipped with a pressure-reducing mechanism and an air-blowing mechanism was charged with 404 g of N-MAM, 37 g of ethylene glycol, 0.5% by weight, based on N-MAM, of oxalic acid and $5\times10^{-3}$% based on N-MAM, of hydroquinone, the mixture was stirred, and the temperature was elevated to 50° C. under a reduced pressure while blowing air into the reaction vessel. The reaction was carried out at this temperature for 5 hours while removing water by distillation, and a powdery hardenable binder D comprising 90% by weight of a mixture of ethylene glycol diacrylamide and diacrylamide dimethyl ether was obtained.

PRODUCTION EXAMPLE 5

The same reaction vessel as used in Production Example 4 was charged with 404 g of N-MAM, 0.5% by weight, based on N-MAM, of oxalic acid and $5\times10^{-3}$% by weight, based on N-MAM, of hydroquinone, the mixture was stirred, and the temperature was elevated to 50° C. under a reduced pressure while blowing air into the reaction vessel. At this temperature, the reaction was carried out for 3 hours while removing water by distillation, whereby a powdery hardenable binder E comprising 95% by weight of diacrylamide dimethyl ether was obtained.

PRODUCTION EXAMPLE 6

The same reaction vessel as used in Example 1 was charged with 303 g of N-MAM, 92 g of glycerol, 1% by weight, based on N-MAM, of oxalic acid and $5\times10^{-3}$% by weight, based on N-MAM, of hydroquinone, the mixture was stirred, and the temperature was elevated to 60° C. under a reduced pressure. At this temperature, the reaction was carried out for 6 hours while removing water by distillation. The reaction mixture was cooled to normal temperature and 1% by weight, based on the hardenable binder, of a vinyl type silane, A-172 supplied by Nippon Unicar, was added to the reaction mixture to obtain a liquid hardenable binder F.

PRODUCTION EXAMPLE 7

A liquid hardenable binder G was prepared in the same manner as described in Example 6 except that the amount of N-MAM was changed to 404 g and 212 g of diethylene glycol was used instead of N-MAM and glycerol used in Example 6.

EXAMPLE 1

In a whirl mixer supplied by Enshu Tekko, 5 kg of Fremantle sand heated at about 90° C and 100 g of the hardenable binder A prepared in Production Example 1 were charged and mixed for 30 seconds, 40 g of a 10% by weight solution of benzoyl peroxide in acetone and 1 g of an amino type silane (A-1100 supplied by Nippon Unicar) were added, and mixing was continued while blowing air into the mixer until the mixture was disintegrated. Then, 5 g of calcium stearate was added to the mixture and mixing was carried out for 10 seconds, to obtain a dry shell mold-forming material having a good free flowability.

EXAMPLE 2

A dry shell mold-forming material having a good free flowability was prepared in the same manner as described in Example 1 except that 100 g of the hardenable binder B prepared in Production Example 2 was used instead of the hardenable binder A used in Example 1.

EXAMPLE 3

A dry shell mold-forming material having a good free flowability was prepared in the same manner as described in Example 1 except that 100 g of the hardenable binder C prepared in Production Example 3 was used instead of the hardenable binder A used in Example 1.

EXAMPLE 4

A dry shell mold-forming material having a good free flowability was prepared in the same manner as described in Example 1 except that 90 g of the hardenable binder A and 10 g of acrylamide were used instead of the hardenable binder A used in Example 1.

COMPARATIVE EXAMPLE 1

In a whirl mixer by Enshu Tekko, 5 kg of Fremantle sand heated at about 150° C. and 75 g of a phenolic resin for a shell mold (SP-800H supplied by Asahi Yukizai Kogyo) were charged and mixed for 40 seconds, and 86.3 g of a 13% by weight aqueous solution of hexamine was added to the mixture. Mixing was continued while blowing air into the mixer until the mixture was disintegrated, then 5 g of calcium stearate was added to the mixture, and mixing was carried out for 10 seconds to obtain a dry mold-forming material having a good free flowability.

With respect to each of the shell mold-forming materials prepared in Examples 1 through 4 and Comparative Example 1, the bending strength (kg/cm$^2$) was measured according to the JACT test method SM-1. The results are shown in Table 1.

TABLE 1

| Curing Conditions | Example No. 1 | 2 | 3 | 4 | Comparative Example 1 |
|---|---|---|---|---|---|
| Bending strength | | | | | |
| 130° C. × 60 seconds | 40.6 | 45.2 | 38.4 | 46.7 | Uncured |
| 150° C. × 60 seconds | 42.4 | 46.4 | 43.2 | 51.4 | Uncured |
| 250° C. × 60 seconds | — | — | — | — | 50.2 |

With respect to each of the mold-forming materials obtained in Examples 1 and 2 and Comparative Example 1, the disintegrability was evaluated by the test method described below. The results are shown in Table 2.

TABLE 2

| Shaking time | Example 1 | Example 2 | Comparative Example 1 |
|---|---|---|---|
| Disintegrability (%) | | | |
| 0 second | 40 | 50 | 2 |
| 2 seconds | 100 | 100 | 8 |
| 4 seconds | | | 14 |
| 6 seconds | | | 20 |
| 8 seconds | | | 26 |
| 10 seconds | | | 30 |

Evaluation of Disintegrability of Mold-Forming Material

At first, a dog-bone type core 1 (thickness =25 mm, width =40 nnn, length =75 mm) for the disintegration test, as shown in FIG. 1, was prepared by using a mold-forming material, and a main mold 2 (thickness =75 mm, width =80 mm, length =125 mm) having a space a little larger than that of the core 1 was prepared by using an organic self-curable mold-forming material. Then the core 1 was set in the main mold 2, and a molten aluminum alloy maintained at a temperature of 720° C. was cast in the mold and naturally cooled to room temperature, to obtain an aluminum casting 3 shown in Table 2. The casting 3 was shaken for a predetermined time by an air hammer under 0.4 kg/cm², the disintegrated sand was taken out through a discharge opening 4 having a diameter of 16 mm, and the weight was measured. This operation was repeated until the core sand was completely discharged from the casting 3. The disintegrability of the mold-forming material was expressed by the weight percent of the weight of the sand discharged for a predetermined time based on the total weight of the sand.

EXAMPLE 5

In a whirl mixer supplied by Enshu Tekko, 5 kg of Fremantle sand maintained at normal temperature, 100 g of the hardenable binder D prepared in Production Example 4, 4 g of a 50% by weight solution of methylethylketone peroxide in dimethyl phthalate and 1 g of aminosilane A-1100 were charged and mixed for 120 seconds, 5 g of calcium stearate was added to the mixture, and mixing was carried out for 10 seconds to obtain a dry shell mold-forming material having a good free flowability.

EXAMPLE 6

A dry shell mold-forming material having a good free flowability was prepared in the same manner as described in Example 5 except that the hardenable binder E prepared in Production Example 5 was used instead of the hardenable binder D used in Example 5.

COMPARATIVE EXAMPLE 2

In a whirl mixer supplied by Enshu Tekko, 5 kg of Fremantle sand heated at about 150° C and 75 g of a phenolic resin for a shell mold (SP600 supplied by Asahi Yukizai Kogyo) were charged and mixed for 40 seconds, and 86.3 g of a 13% by weight aqueous solution of hexamine was added to the mixture and mixing was continued under blowing of air until the mixture was disintegrated. Then, 5 g of calcium stearate was added to the mixture, and mixing was carried out for 10 seconds to obtain a dry shell mold-forming material having a good free flowability.

With respect to each of the shell mold-forming materials obtained in Example 5 and 6 and Comparative Example 2, the bending strength (kg/cm²) was measured according to the JACT test method SM-1 and the disintegrability was evaluated by the above-mentioned test method. The results are shown in Table 3.

TABLE 3

| Curing Conditions | Example No. 5 | Example No. 6 | Comparative Example 2 |
|---|---|---|---|
| Bending strength | | | |
| 130° C. × 60" | 35.0 | 31.4 | Uncured |
| 150° C. × 60" | 57.4 | 54.2 | Uncured |
| 250° C. × 60" | | | 62.4 |
| Disintegrability (%) | | | |
| 0 second | 50 | 40 | 0 |
| 2 seconds | 100 | 100 | 6 |
| 4 seconds | | | 10 |
| 6 seconds | | | 14 |
| 8 seconds | | | 20 |
| 10 seconds | | | 24 |

EXAMPLE 7

Shinagawa-type table mixer was charged with 2 kg of Fremantle sand and 30 g of the hardenable binder F prepared in Production Example 6, and the mixture was mixed for 30 seconds. Then, 7 g of a 14% by weight solution of benzoyl peroxide in acetone was added to the mixture and mixing was carried out for 30 seconds to obtain a wet hot box mold-forming material.

EXAMPLE 8

A wet hot box mold-forming material was prepared in the same manner as described in Example 7 except that 30 g of the hardenable binder G prepared in Production Example 7 was used instead of the hardenable binder F used in Example 7.

COMPARATIVE EXAMPLE 3

In a Shinagawa-type table mixer, 2 kg of Fremantle sand and 10.5 g of a sulfonic acid type curing agent (H-22 supplied by Asahi Yukizai Kogyo) were charged and mixed for 30 seconds, and 35 g of phenolic resin for a hot box mold (HP2500 supplied by Asahi Yukizai Kogyo) was added to the mixture and mixing was carried out for 30 seconds to obtain a wet hot box mold-forming material.

With respect to each of the hot box mold-forming materials obtained in Examples 7 and 8 and Comparative Example 3, the bending strength and pot life were measured by test methods described below. The results are shown in Table 4.

TABLE 4

| Curing Conditions | Example 7 | Example 8 | Comparative Example 3 |
|---|---|---|---|
| Bending strength | | | |
| 120° C. × 60 seconds | 28.0 | 18.4 | uncured |
| 140° C. × 60 seconds | 60.2 | 56.5 | uncured |
| 160° C. × 60 seconds | 61.4 | 59.4 | uncured |
| 180° C. × 60 seconds | 56.2 | 53.2 | 18.4 |
| 200° C. × 60 seconds | 54.4 | 51.8 | 54.2 |
| Pot Life | more than 36 hours | more than 36 hours | 6 hours |

Bending Strength

The molding material was blown under a pressure of kg/cm² in a metal mold maintained at a predetermined temperature and curing was carried out for 60 seconds to obtain a test piece (thickness =25 mm, width =25 mm, length =120 mm). The obtained test piece was cooled to normal temperature and the Bending strength (kg/cm²) was measured.

Pot Life

The mold-forming material just after mixing was sealed in a vinyl bag and allowed to stand at normal temperature for an optional time. The bag was opened and the Bending strength of the mold-forming material was measured (curing conditions: 140° C.×60 seconds in Examples 7 and 8 and 200° C.×60 seconds in Comparative Example 3). The standing time resulting in a reduction of the Bending strength to 80% of the Bending strength just after mixing was designated as the pot life.

COMPARATIVE EXAMPLE 4

In a Shinagawa type mixer, 2 kg of Freemantle sand and 30 g of the hardenable binder F prepared in Production Example 6 were charged and mixed for 30 seconds. Then, 15 g of a 10% by weight solution of benzoyl peroxide in acetone and 6 g of a 5% by weight solution of dimethylaniline in acetone were added to the mixture, and mixing was further carried out for 30 seconds to obtain a wet normal-temperature hardenable mold-forming material.

COMPARATIVE EXAMPLE 4

A Shinagawa type table mixer was charged with 2 kg of Fremantle sand and 6 g of an organic sulfonic acid type curing agent (F-3 supplied by Asahi Yukizai Kogyo) and the mixture was mixed for 30 seconds. Then, 20 g of a urea-furan resin (HP4021 supplied by Asahi Yukizai Kogyo) was added to the mixture and mixing was further carried out for 30 seconds to obtain a wet normal-temperature hardenable mold-forming material.

With respect to each of the mold-forming materials prepared in Example 9 and Comparative Example 4, the compression strength and pot life were measured by the following test methods. The results are shown in Table 5.

TABLE 5

| Standing Time (hours) of Test Piece | Example 9 | Comparative Example 4 |
|---|---|---|
| Compression strength | | |
| 0.5 | 1.0 | 0.9 |
| 1 | 24.0 | 9.0 |
| 3 | 34.2 | 26.1 |
| 24 | 48.0 | 53.1 |
| Pot Life | 20 minutes | 6 minutes |

Compression Strength

The mold-forming material just after mixing was hand-rammed in a pattern having a plurality of test piece cavities (diameter = 50 mm, height = 50 mm) and was allowed to stand at normal temperature. After the passage of a predetermined time (0.5, 1, 3 or 24 hours), the test piece was taken out and the compression strength (kg/cm$^2$) was measured.

Pot Life

The mold-forming material just after mixing was sealed in a vinyl bag and allowed to stand at normal temperature for an optional time. Then, the bag was opened and the compression strength (strength after 24 hours' standing) of the mold-forming material was measured. The standing time resulting in a reduction of the compression strength to 80% of the compression strength just after mixing was designated as the pot life.

EXAMPLE 10

In a whirl mixer supplied by Enshu Tekko, 5 kg of Fremantle sand heated at about 90° C. and 100 g of the hardenable binder E prepared in Production Example 5 were charged and mixed for 30 seconds. Then, 40 g of a 10% by weight solution of benzoyl peroxide in acetone and 1 g of aminosilane A-1100 were added to the mixture, and mixing was continued under blowing of air until the mixture was disintegrated. Then, 5 g of calcium stearate was added to the mixture and mixing was further carried out for 10 seconds to obtain a dry shell mold-forming material having a good free flowability.

EXAMPLES 11 THROUGH 17

In a whirl mixer supplied by Enshu Tekko, 5 kg of Fremantle sand heated at about 90° C., 100 g of the hardenable binder E prepared in Production Example 5 and a predetermined amount of additive A (saturated amide compound or solid alcohol) shown in Table 6 were charged and mixed 30 seconds. Then, 40 g of a 10% by weight solution of benzoyl peroxide in acetone and 1 g of aminosilane A-1100 were added to the mixture and mixing was continued under blowing of air until the mixture was disintegrated. Then, 5 g of calcium stearate was added to the mixture and mixing was carried out for 10 seconds to obtain a dry shell mold-forming material having a good free flowability.

EXAMPLES 18 THROUGH 21

In a whirl mixer supplied by Enshu Tekko, 5 kg of Fremantle sand heated at about 90° C. and 100 g of the hardenable binder E prepared in Production Example 5 were charged and mixed for 30 seconds, and 40 g of a 10% by weight solution of benzoyl peroxide in acetone, 1 g of aminosilane A-1100 and a predetermined amount of additive B (thermoplastic resin) shown in Table 6 were added to the mixture and mixing was continued under blowing of air until the mixture was disintegrated. Then, 5 g of calcium stearate was added to the mixture and mixing was carried out for 10 seconds to obtain a dry shell mold-forming material having a good free flowability.

PRODUCTION EXAMPLES 22 AND 23

In a whirl mixer supplied by Enshu Tekko, 5 kg of Fremantle sand heated at about 90° C., 100 g of the hardenable binder E prepared in Production Example 5 and a predetermined amount of additive A (saturated amide compound or solid alcohol]shown in Table 6 were charged and mixed for 30 seconds. Then, 40 g of a 10% by weight solution of benzoyl peroxide in acetone, 1 g of aminosilane A-1100 and 25 g of a 20% by weight solution of a vinyl acetate resin in acetone were added to the mixture and mixing was continued under blowing of air until the mixture was disintegrated. Then, 5 g of calcium stearate was added to the mixture and mixing was carried out for 10 seconds to obtain a dry shell mold-forming material having a good free flowability.

With respect to each of the shell mold-forming materials obtained in Examples 10 through 23, the bending strength was measured according to the JACT test method SM-1, and the moisture absorption, blocking resistance and flowability were evaluated by test methods described below. The results are shown in Table 6.

TABLE 6

| | Example No. | | | | | | | |
|---|---|---|---|---|---|---|---|---|
| | 10 | 11 | 12 | 13 | 14 | 15 | 16 | 17 |
| Additive A | | | | | | | | |
| kind | | acetic acid amide | aceta-nilide | acetoacetic acid amide | caprolactam | dimethyl-formamide | 1,6-hexane-diol | trimethylol-propane |
| amount added (% by weight based on hardenable binder) | | 5 | 5 | 5 | 5 | 3 | 5 | 5 |
| Additive B | | | | | | | | |
| kind | | | | | | | | |
| amount added (% by weight based | | | | | | | | |

TABLE 6-continued

| | | | | | | | | |
|---|---|---|---|---|---|---|---|---|
| on hardenable binder) | | | | | | | | |
| Bending strength 150° C. × 60 seconds | 40.4 | 49.2 | 51.6 | 50.4 | 48.3 | 50.2 | 48.6 | 47.4 |
| Moisture Absorption (%) | 1.3 | 1.6 | | | | | | |
| Blocking Resistance (%) | 60 | 80 | | | | | | |
| Flowability (seconds) | 9.8 | 9.8 | | | | | | |

| | Example No. | | | | | |
|---|---|---|---|---|---|---|
| | 18 | 19 | 20 | 21 | 22 | 23 |
| Additive A | | | | | | |
| kind | | | | | acetic acid amide | 1,6-hexane diol |
| amount added (% by weight based on hardenable binder) | | | | | 5 | 5 |
| Additive B | | | | | | |
| kind | 20% solution of vinyl acetate resin in acetone | 20% solution of vinyl acetate/ethylene copolymer in toluene | 20% solution of methacrylic acid ester resin in acetone | polyethylene powder | 20% solution of vinyl acetate resin in acetone | 20% solution of vinyl acetate resin in acetone |
| amount added (% by weight based on hardenable binder) | 25 | 25 | 25 | 5 | 25 | 25 |
| Bending strength 150° C. × 60 seconds | 44.0 | 42.0 | 41.0 | 38.4 | 52.6 | 49.2 |
| Moisture Absorption (%) | 0.6 | 0.5 | 0.5 | 0.7 | 0.8 | 0.8 |
| Blocking Resistance (%) | 15 | 10 | 10 | 15 | 20 | 20 |
| Flowability (seconds) | 8.8 | 8.9 | 8.8 | 9.0 | 8.9 | 9.0 |

Evaluation of Moisture Absorption Resistance of Mold-Forming Material

In a glass Petri dish having a diameter of 5 cm, 10 g, precisely measured, of the mold-forming material was charged in a uniform thickness and the material was allowed to stand at room temperature for 24 hours in a desiccator filled with water. Then, the weight of the material was measured. The moisture absorption was expressed by the ratio (% by weight) of the increase of the weight to the original weight of the mold-forming material.

Evaluation of Blocking Resistance of Mold-Forming Material

A polyethylene vessel having a diameter of 10 cm and a capacity of 500 ml was charged with 500 g of the mold-forming material, and a plastic disk having a diameter of 9.5 cm and a thickness of 2 mm was placed on the material and a weight of 500 g was placed on the disk. Then, the mold-forming material was allowed to stand for 1 hour in a thermostat machine maintained at 50° C. and gently placed on a 10-mesh sieve after cooling. The weight of the blocked sand left on the sieve was measured, and this weight was divided by 500 g and the value was expressed in terms of % by weight.

Evaluation of Flowability

A glass funnel as shown in FIG. 3 was vertically fixed to a support stand, and the discharge opening was plugged by a glass rod having a diameter of 8 mm. Then, 60 g of the mold-forming material was charged in the funnel and the surface was levelled. The glass rod was removed, and simultaneously, a stop watch was actuated. The time required for discharging all of the mold-forming material was measured.

INDUSTRIAL APPLICABILITY

The mold-forming material of the present can be advantageously applied to mold-forming methods such as the shell mold process, the hot box process, the warm box process and the normal-temperature hardening process, and can be used for the production of a main mold or core to be used for gravity casting, low-pressure casting or high-pressure casting (for the production of a die-cast product).

We claim:

1. A composition for making a mold in a shell mold process, which consists essentially of a refractory aggregate, a heat hardenable binder and, optionally, at least one additive, said heat hardenable binder comprising a solid polyfunctional acrylamide having at least two ethylenically unsaturated groups in the molecule in an amount of at least 50% by weight of the total weight of the heat hardenable binder, said composition being both dry and free flowing.

2. A material for a mold according to claim 1, wherein the heat hardenable binder further comprises monofunctional acrylamide having one ethylenically unsaturated group in the molecule.

3. A material for a mold according to claim 1, wherein the heat hardenable binder further comprises at least one compound selected from the group consisting of ethylenically unsaturated compounds other than said acrylamide, epoxy compounds, melamine compounds, urea compounds, furan compounds and reaction products thereof.

4. A material for a mold according to claim 1, wherein the heat hardenable binder comprises at least 70% by weight of the polyfunctional acrylamide.

5. A material for a mold according to claim 4, wherein the heat-hardenable binder comprises at least 90% by weight of the polyfunctional acrylamide.

6. A material for a mold according to claim 1, wherein the heat hardenable binder is contained in an amount of 0.3 to 5 parts by weight per 100 parts by weight of the refractory aggregate.

7. A material for a mold according to claim 6, wherein the heat hardenable binder is contained in an amount of 0.5 to 3 parts by weight per 100 parts by weight of the refractory aggregate.

8. A material for a mold according to claim 1, wherein the polyfunctional acrylamide is at least one member selected from the group consisting of compounds represented by the following formulae (I), (II), (III) and (IV):

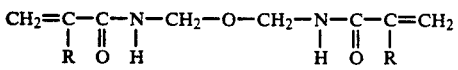

(I)

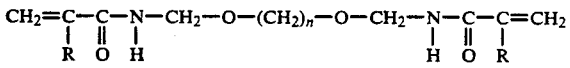

(II)

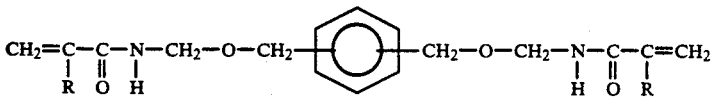

(III)

and

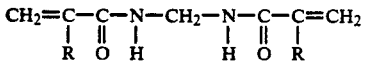

(IV)

wherein R represents a hydrogen atom or an alkyl group having 1 to 5 carbon atoms, and n is an integer of from 2 to 6.

9. A material for a mold according to claim 1, which further comprises a silane coupling agent.

10. A material for a mold according to claim 1, which further comprises a polymerization initiator or a mixture of a polymerization initiator and a polymerization promoter.

11. A material for a mold according to claim 1, which further comprises a polymerization inhibitor.

12. A material for a mold according to claim 1, which further comprises at least one additive selected from the group consisting of saturated amide compounds and solid alcohols.

13. A material for a mold according to claim 12, which further comprises a thermoplastic resin.

14. A process for casting an article of a low melting point metal in a shell mold process, said process comprising:

preparing a composition as claimed in claim 1, forming said composition into a shape of a mold and/or core, heating said shaped composition to harden said composition, using said hardened shaped composition as a mold and/or a core, casting a molten metal into a mold comprising said mold and/or a core, and demolding the cast article.

15. A process according to claim 14, wherein the mold-forming material further comprises a hardening promoter selected from a group consisting of a polymerization initiator and a mixture of a polymerization initiator and a polymerization promoter.

* * * * *